US008863546B2

(12) United States Patent
Oberweis

(10) Patent No.: US 8,863,546 B2
(45) Date of Patent: Oct. 21, 2014

(54) MULTICOMPARTMENT COOLER WITH ENHANCED FEATURES

(75) Inventor: Joseph S. Oberweis, Sugar Grove, IL (US)

(73) Assignee: The Oberweis Group, Inc., North Aurora, IL (US)

( * ) Notice: Subject to any disclaimer, the term of this patent is extended or adjusted under 35 U.S.C. 154(b) by 261 days.

(21) Appl. No.: 13/035,814

(22) Filed: Feb. 25, 2011

(65) Prior Publication Data

US 2011/0203297 A1 Aug. 25, 2011

Related U.S. Application Data

(60) Provisional application No. 61/308,150, filed on Feb. 25, 2010.

(51) Int. Cl.

| | |
|---|---|
| ***F25D 11/02*** | (2006.01) |
| ***F25D 13/02*** | (2006.01) |
| ***F25D 19/00*** | (2006.01) |
| ***F25D 3/08*** | (2006.01) |
| ***F25D 3/02*** | (2006.01) |
| ***B65D 53/00*** | (2006.01) |
| ***B65D 21/02*** | (2006.01) |
| ***F25D 3/12*** | (2006.01) |
| ***F25D 3/14*** | (2006.01) |
| *F25D 31/00* | (2006.01) |

(52) U.S. Cl.

CPC ..... *F25D 3/14* (2013.01); *F25D 2303/082* (2013.01); *F25D 2303/0844* (2013.01); *F25D 31/005* (2013.01)

USPC ..... 62/384; 62/441; 62/442; 62/443; 62/452; 62/456; 62/457.7; 62/459; 62/465; 220/238.7; 220/23.89; 220/23.88; 220/592.03; 220/528; 220/592.1; 220/501

(58) Field of Classification Search

CPC ..... F25D 3/00; F25D 3/02; F25D 3/06; F25D 3/08; F25D 5/02

USPC ..... 62/441–443, 452, 456, 457.7, 459, 465; 220/238.7, 23.89, 23.88, 592.03, 220/592.1, 501, 528

See application file for complete search history.

(56) References Cited

U.S. PATENT DOCUMENTS 2,145,777 A * 1/1939 Muffly ..... 62/73
3,387,762 A * 6/1968 Zupon ..... 229/120.02

(Continued)

FOREIGN PATENT DOCUMENTS

| | | | |
|---|---|---|---|
| WO | 0070279 | A1 | 11/2000 |
| WO | 0231417 | A1 | 4/2002 |
| WO | 2006098711 | A1 | 9/2006 |

OTHER PUBLICATIONS

Carr et al., A Fully Portable, Cryocooler-Based HTS SQUID NDE Instrument, IEEE Transactions on Applied Superconductivity, Jun. 2003, pp. 245-249, vol. 13, Issue 2, Part 1.

(Continued)

*Primary Examiner* — Frantz Jules
*Assistant Examiner* — Erik Mendoza-Wilkenfe
(74) *Attorney, Agent, or Firm* — Banner & Witcoff, Ltd.

(57) ABSTRACT

This disclosure presents a stackable, multicompartment portable cooler with enhanced climate control and delivery features. The cooler may include adjustable vents for precisely controlling the temperature differential between adjacent compartments, a brochure receptor for including information about the delivery, and/or an automatic delivery flag for notification purposes. In addition, the cooler is modular and may be assembled/disassembled through the use of removable compartment dividers that subdivide the stacked main compartments into many subcompartments.

16 Claims, 7 Drawing Sheets

(56) References Cited

U.S. PATENT DOCUMENTS

| | | | | |
|---|---|---|---|---|
| D259,760 | S | 7/1981 | Lucas et al. | |
| 4,286,440 | A | 9/1981 | Taylor | |
| D272,428 | S | 1/1984 | Kelley | |
| 4,499,998 | A * | 2/1985 | Carlson | 206/541 |
| 4,655,052 | A | 4/1987 | Garcia | |
| 4,858,444 | A | 8/1989 | Scott | |
| 4,873,841 | A | 10/1989 | Bradshaw et al. | |
| D322,738 | S | 12/1991 | Onweiler | |
| 5,161,389 | A | 11/1992 | Rockenfeller et al. | |
| 5,263,339 | A | 11/1993 | Evans | |
| 5,297,616 | A * | 3/1994 | Pralus | 165/47 |
| 5,319,937 | A | 6/1994 | Fritsch et al. | |
| 5,337,579 | A | 8/1994 | Saia, III et al. | |
| D396,779 | S | 8/1998 | Moffett et al. | |
| 5,860,281 | A | 1/1999 | Coffee et al. | |
| D407,609 | S | 4/1999 | Rausch | |
| D416,447 | S | 11/1999 | Levy et al. | |
| D423,294 | S | 4/2000 | Klein et al. | |
| 6,067,813 | A | 5/2000 | Smith | |
| 6,474,097 | B2 | 11/2002 | Treppedi et al. | |
| 6,571,568 | B1 * | 6/2003 | Link | 62/244 |
| 6,644,063 | B2 | 11/2003 | Mogil | |
| D488,030 | S | 4/2004 | Drzymala | |
| 6,761,041 | B2 * | 7/2004 | Roth et al. | 62/457.2 |
| 6,763,678 | B2 * | 7/2004 | Harper | 62/461 |
| 6,862,896 | B1 | 3/2005 | Seidl | |
| 6,895,778 | B1 | 5/2005 | Ackerman | |
| 6,966,450 | B2 | 11/2005 | Askew | |
| 6,997,007 | B1 | 2/2006 | Wyatt | |
| 7,040,115 | B1 * | 5/2006 | Lopez et al. | 62/457.2 |
| 7,055,642 | B1 * | 6/2006 | Chambers et al. | 180/312 |
| D525,084 | S | 7/2006 | Willis | |
| 7,178,673 | B1 | 2/2007 | Miller | |
| 7,299,652 | B2 | 11/2007 | Gagnon | |
| D567,594 | S | 4/2008 | Giovino | |
| 7,415,794 | B1 | 8/2008 | Thompson | |
| 7,415,839 | B2 | 8/2008 | Robertson et al. | |
| 7,451,603 | B2 | 11/2008 | Tuszkiewicz et al. | |
| 7,559,602 | B2 | 7/2009 | Ward et al. | |
| 7,681,405 | B2 | 3/2010 | Williams | |
| 7,950,249 | B1 * | 5/2011 | White et al. | 62/464 |
| 8,327,659 | B2 * | 12/2012 | Winkler et al. | 62/457.7 |
| 2002/0029992 | A1 * | 3/2002 | Purvis | 206/459.1 |
| 2003/0029867 | A1 * | 2/2003 | Vicknair | 220/23.87 |
| 2003/0101744 | A1 | 6/2003 | Harper | |
| 2003/0230109 | A1 * | 12/2003 | Link | 62/420 |
| 2004/0035143 | A1 | 2/2004 | Mogil | |
| 2004/0069009 | A1 * | 4/2004 | Tedder | 62/457.7 |
| 2004/0262319 | A1 * | 12/2004 | Fisher | 220/592.03 |
| 2005/0035119 | A1 | 2/2005 | Hull et al. | |
| 2005/0035120 | A1 * | 2/2005 | Hull et al. | 220/23.87 |
| 2005/0279123 | A1 | 12/2005 | Maldonado | |
| 2005/0279124 | A1 | 12/2005 | Maldonado | |
| 2006/0006218 | A1 * | 1/2006 | Bundy | 232/35 |
| 2006/0086132 | A1 * | 4/2006 | Maglinger et al. | 62/344 |
| 2006/0288730 | A1 | 12/2006 | Shill | |
| 2007/0125118 | A1 | 6/2007 | Hooper | |
| 2007/0137245 | A1 | 6/2007 | Ward | |
| 2007/0151283 | A1 * | 7/2007 | Whewell | 62/388 |
| 2008/0022712 | A1 * | 1/2008 | Carr | 62/425 |
| 2008/0047296 | A1 | 2/2008 | Helmer | |
| 2008/0127668 | A1 | 6/2008 | Devito et al. | |
| 2008/0178629 | A1 | 7/2008 | Meether | |
| 2008/0282907 | A1 | 11/2008 | Begin et al. | |
| 2009/0049860 | A1 | 2/2009 | Manner et al. | |
| 2009/0107163 | A1 | 4/2009 | Lu et al. | |
| 2009/0139248 | A1 | 6/2009 | Crumlin et al. | |
| 2009/0142458 | A1 | 6/2009 | McCann | |
| 2009/0193838 | A1 | 8/2009 | Hamlin | |
| 2009/0217699 | A1 | 9/2009 | Ball | |
| 2010/0147837 | A1 * | 6/2010 | Williams | 220/1.5 |
| 2010/0257889 | A1 * | 10/2010 | Lee | 62/344 |

OTHER PUBLICATIONS

Guarino et al., Characterization of Laminar Jet Impingement Cooling in Porable Computer Applications, IEEE Transactions on Components and Packaging Technologies, Sep. 2002, pp. 337-346, vol. 25, Issue 3.

Tellerux Corp. et al., Thermoelectrics Chill Portable Cooler, Design News, Jan. 22, 1996, p. 37, vol. 52, Issue 2.

Pinella, Gifts for Grads, Dads, Moms and Marrieds, Saturday Evening Post, May-Jun. 1984, pp. 66-68, vol. 256, Issue 4.

* cited by examiner

MULTICOMPARTMENT COOLER WITH ENHANCED FEATURES

CROSS REFERENCE TO RELATED APPLICATIONS

This application claims priority to provisional application Ser. No. 61/308,150 filed on Feb. 25, 2010, the entire contents of which are herein incorporated by reference.

FIELD

The disclosure relates generally to a portable cooler for carrying food and beverages. More specifically, the disclosure provides a cooler with several compartments for storing warm, dry, refrigerated, and/or frozen goods.

BACKGROUND

Coolers are routinely used for transporting goods from one location to another. These coolers may have many compartments to store goods such as beverages, frozen/cooked food, and other items. In addition, these coolers may include dry ice/ice, heat sources, etc., for keeping the items in each compartment at a different temperature.

In some of these designs, one compartment of the cooler may be insulated from others. Insulation between compartments keeps heat/refrigeration confined to a small space, thereby allowing some of the compartments to keep goods warm and other compartments to cool them down. For instance, if ice is placed in one of the compartments of the cooler, the insulated walls of the cooler would allow the cooling effect of and any moisture generated from the ice to be confined to the single compartment. Thus, food/other items placed in adjacent compartments would be protected from the cooler temperatures and higher moisture content of the ice cold compartment. This scenario would be advantageous in situations where, for instance, dry food (e.g., cookies, chips, peanuts, etc) would spoil if placed in prolonged contact with moisture. To provide this insulation, walls between adjacent compartments may be coated with materials such as cloth and/or thermal packs, among other things.

Similarly, in other cooler designs, the walls separating adjacent compartments may be conductive (e.g., by being made out of a conductive material like metal, etc.), thereby allowing heat/refrigeration to pass readily from one compartment to another. With this configuration, a temperature gradient can be created between adjacent compartments. Using the earlier example of ice placed in one of the compartments, a conductive wall between the compartment with ice and an adjacent one may result in the adjacent compartment maintaining a temperature that is cooler than room temperature but at the same time warmer than the ice cold compartment (assuming, of course, that diffusion takes a certain amount of time to equilibrate the temperatures of the two compartments). In addition, moisture may be blocked from entering the adjacent compartment, thereby resulting in cooler with a cool, dry compartment and an ice cold, wet compartment.

If dry ice is used to cool any of the compartments in a multicompartment cooler, moisture generation is not an issue; however, the manipulation of temperature gradients between compartments may be controlled by the use of insulating and conductive barriers between compartments as discussed above. The use of thermal insulators/conductors between compartments provides only a crude level of control for maintaining a temperature differential between compartments.

In addition, conventional coolers are purchased as single size coolers, meaning that they can be used only in one size. Thus, in situations where only a small number of goods are to be transported in the cooler, a large cooler will have a significant amount of unfilled space. Similarly, in situations where a large number of goods are to be transported in the cooler, a smaller cooler will not suffice, thus resulting in the need for use of multiple coolers.

BRIEF SUMMARY

The following presents a simplified summary of the disclosure in order to provide a basic understanding of some aspects of the disclosure. This summary is not an extensive overview of the disclosure. It is not intended to identify key or critical elements of the disclosure or to delineate the scope of the disclosure. The following summary merely presents some concepts of the disclosure in a simplified form as a prelude to the more detailed description provided below.

To overcome limitations in the prior art described above, and to overcome other limitations that will be apparent upon reading and understanding the present specification, the present disclosure is directed to a multicompartment cooler configured to allow more control over the temperature of each compartment.

A first aspect of the disclosure provides a multicompartment portable cooler with adjustable vents to allow cold air to move into lower compartments and warm air to move into upper compartments.

A second aspect of the disclosure provides an enhanced modular cooler that allows some of the compartments to be removed if needed. Other enhanced characteristics of the cooler include a delivery flag that is triggered by the opening of the cooler lid and a brochure receptor for housing documents that may need to accompany the contents of the cooler.

BRIEF DESCRIPTION OF THE DRAWINGS

A more complete understanding of the present disclosure and the advantages thereof may be acquired by referring to the following description in consideration of the accompanying drawings, in which like reference numbers indicate like features, and wherein.

DETAILED DESCRIPTION

In the following description of the various embodiments, reference is made to the accompanying drawings, which form a part hereof, and in which is shown by way of illustration various embodiments in which aspects may be practiced. It is to be understood that other embodiments may be utilized and structural and functional modifications may be made without departing from the scope of the present disclosure.

Aspects described herein provide a multicompartment portable cooler with improved features for temperature and moisture control. The cooler is configured to transport a variety of goods, including food, beverages, and medicine, among other things.

Figure 1B:
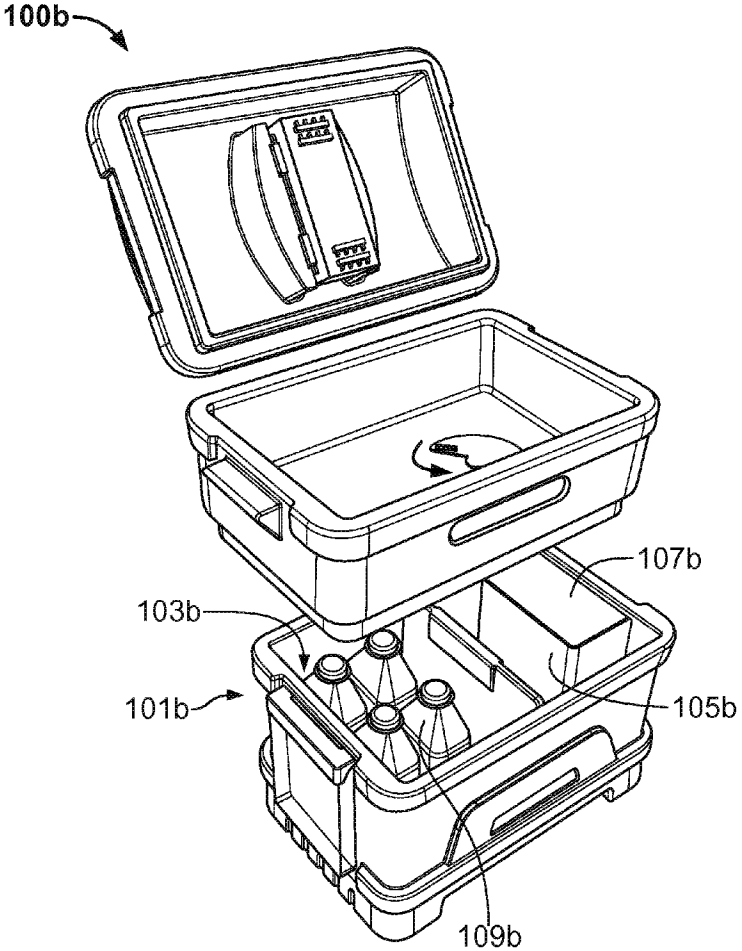
FIG. 1*b* illustrates a multicompartment cooler 100*b* with an assembled base compartment in accordance with an aspect of the disclosure.
Figure 1A:
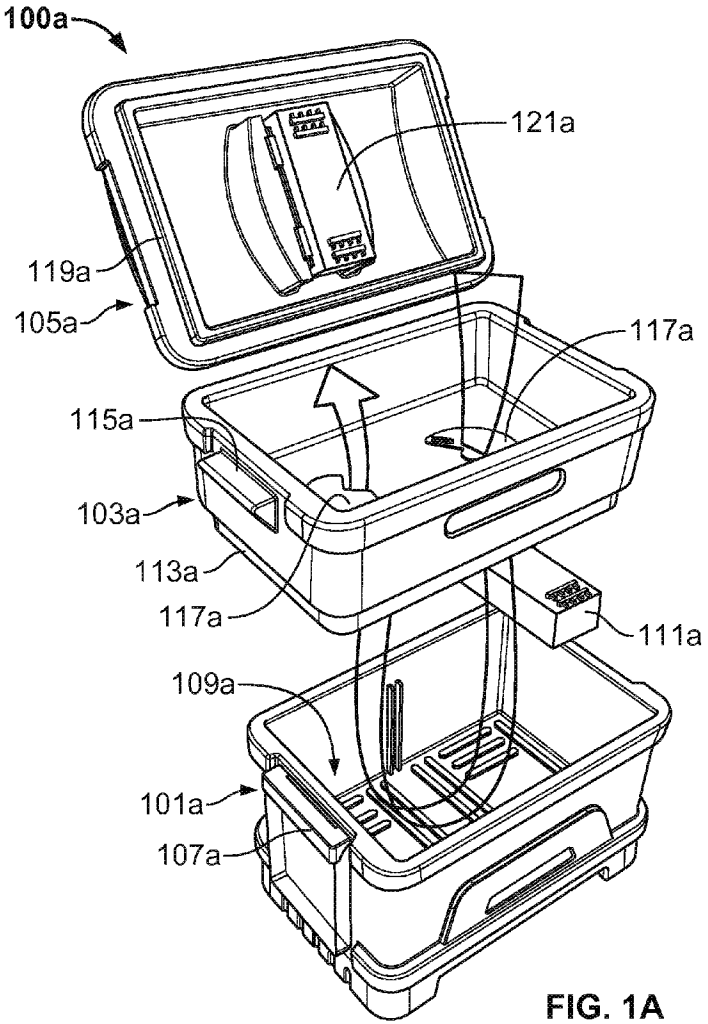
FIG. 1*a* illustrates a portable cooler with adjustable vents in accordance with an aspect of the disclosure.

FIG. 1*a* shows a portable cooler in accordance with at least one aspect of the disclosure. Cooler 100*a* may be manufactured out of various materials, including plastic and wood, among other things. Cooler 100*a* may include a base compartment 101*a*, an intermediate compartment 103*a*, and a lid 105*a*. The base compartment 101*a* may include a number of features such as handles 107*a*, ribs 109*a*, and a heating/cooling element 111*a*. Handles 107*a* may allow the cooler 100*a* to be transported from one place to another with relative ease. Meanwhile, ribs 109*a* may give the floor and/or sidewalls of base compartment 101*a* topography. There may be several advantages to incorporating a base compartment 101*a* with ribs 109*a*. For instance, if there is any moisture due to condensation, melting, or unexpected spills on the floor of base compartment 101*a*, food items may avoid direct contact with the moisture, thereby preventing the food from becoming too soggy, spoiling, and/or other undesirable consequences. It should be noted that while ribs 109*a* are shown only for base compartment 101*a*, ribs 109*a* may be found in any of the other compartments of cooler 100*a*.

Heating/cooling element 111*a* may be implemented in various ways for regulating temperature within base compartment 101*a*. In one embodiment, element 111*a* may include a heating element such as a chemical heating pad and/or a powered heating element, among other things. Element 111*a* may be attached to the roof of base compartment 101*a* with screws, adhesive, or using other techniques. In other embodiments, temperature element 111*a* may be a cooling element, such as a container for dry ice and/or a powered refrigeration component, among other things. While temperature element 111*a* is shown on top of base compartment 101*a*, it should be noted that element 111*a* may be found anywhere within base compartment 101*a*.

Cooler 100*a* may also include an intermediate compartment 103*a* above the base compartment 101*a*. Intermediate compartment 103*a* may be designed such that it fits into base compartment 101*a* through a variety of means. In one embodiment, intermediate compartment 103*a* may include a recess 113*a* around the periphery of its base to allow the intermediate compartment 103*a* to fit snugly into base compartment 101*a*. To allow this type of mating, the walls of intermediate compartment 103*a* may be angled give the intermediate compartment 103*a* a larger surface area at the top of the compartment compared to the surface area at the bottom of the compartment. Intermediate compartment 103*a* may include its own handle 115*a* for assembling the cooler 100*a* and/or transporting it from one location to another. In other embodiments, intermediate compartment 103*a* and base compartment 101*a* may be affixed together with screws, adhesives, and caulk, among other materials.

In accordance with an aspect of the disclosure, the intermediate compartment 103*a* may include adjustable vents 117*a* to allow cold/hot air to move between adjacent compartments. Adjustable vents 117*a* may be manufactured in the floor of intermediate compartment 103*a*. Vents 117*a* may include a slideable panel to open and close adjustable vents 117*a*. When adjustable vents 117*a* are opened, temperature element 111*a* may cause cold/hot air to diffuse from the base compartment 101*a* to intermediate compartment 103*a*.

Moreover, further enhancement and adjustment of the diffusion process is possible with the inclusion of more than a single heating/cooling element, such as including temperature element 121*a* as a heating/cooling element and temperature element 111*a* as a heating/cooling element. If both temperature elements 111*a* and 121*a* function as cooling elements (or heating elements), then cooling (heating) may occur more quickly, again with the net result of intermediate compartment 103*a* having an overall higher air temperature than base compartment 101*a*. Alternatively, additional temperature elements (or temperature elements of increased/decreased size or quantity) could be included to alter temperatures, cooling/heating times and longevity.

Experimental tests were conducted to measure the temperature of milk cartons placed in a multicompartment cooler 100*a* compared to the temperature of similar cartons of milk placed in a conventional single compartment cooler. In this test, the multicompartment cooler 100*a* had dry ice placed in the intermediate compartment 103*a*, milk was placed in the base compartment 101*a*, and the vents 117*a* between the base compartment 101*a* and intermediate compartment 103*a* were completely opened to allow cool air to move into base compartment 101*a* and keep the milk placed therein cool.

Figure 2:
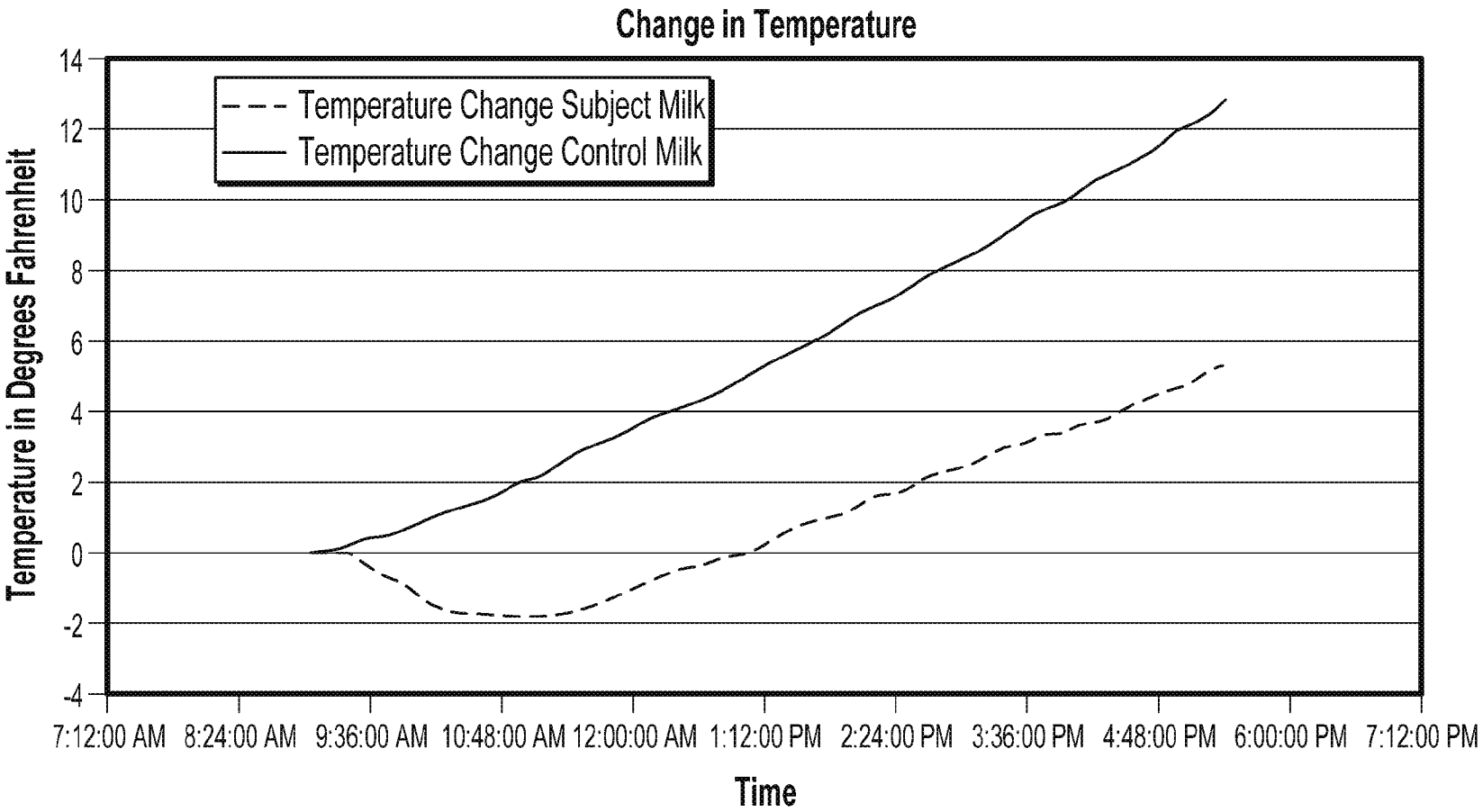
FIG. 2 illustrates the change in temperature of milk placed in a cooler with and without a cooling source in accordance with an aspect of the disclosure.

FIG. 2 shows the change in temperature of milk placed in a cooler with and without a cooling source (e.g., dry ice) in an intermediate compartment 103*a* (and the temperature outside the cooler is warm) in accordance with an aspect of the disclosure. In the experiment shown in FIG. 2, milk was placed in the base compartment 101*a* of a multicompartment cooler. As a note, water and milk freezes at 32° F. Also, as is commonly known, frozen water/milk occupies more volume than liquid milk/water; therefore, if a container holding a limited quantity of milk/water reaches the freezing temperature of the milk/water, the container will break due to the increased volume of the contents. In FIG. 2, the "temperature change subject milk" line represents the condition where dry ice was placed in the intermediate compartment 103*a*, milk was placed in the base compartment 101*a*, and vents 117*a* were opened. Meanwhile, the "temperature change control milk" line represents the condition where no dry ice was placed in a standard one compartment cooler. In both cases, the temperature change of the milk in the base compartment 101*a* was measured versus time. As shown in FIG. 2, when dry ice is added to the intermediate compartment 103*a* (with vents 117*a* open) of a multicompartment cooler, milk placed in the base compartment 101*a* is kept cooler over time than the case where no dry ice is placed in a standard one compartment cooler. Thus, the cooling effect shown in FIG. 2 establishes one example of the functionality of the vents 117*a* (i.e., the vents 117*a* effectively transfer the cool air from the compartment with the dry ice to the base compartment 101*a*. More specifically, the cool air in the intermediate compartment 103*a* with the dry ice sinks through the vents 117*a* to cool the milk in the base compartment 101*a*.

Figure 3:
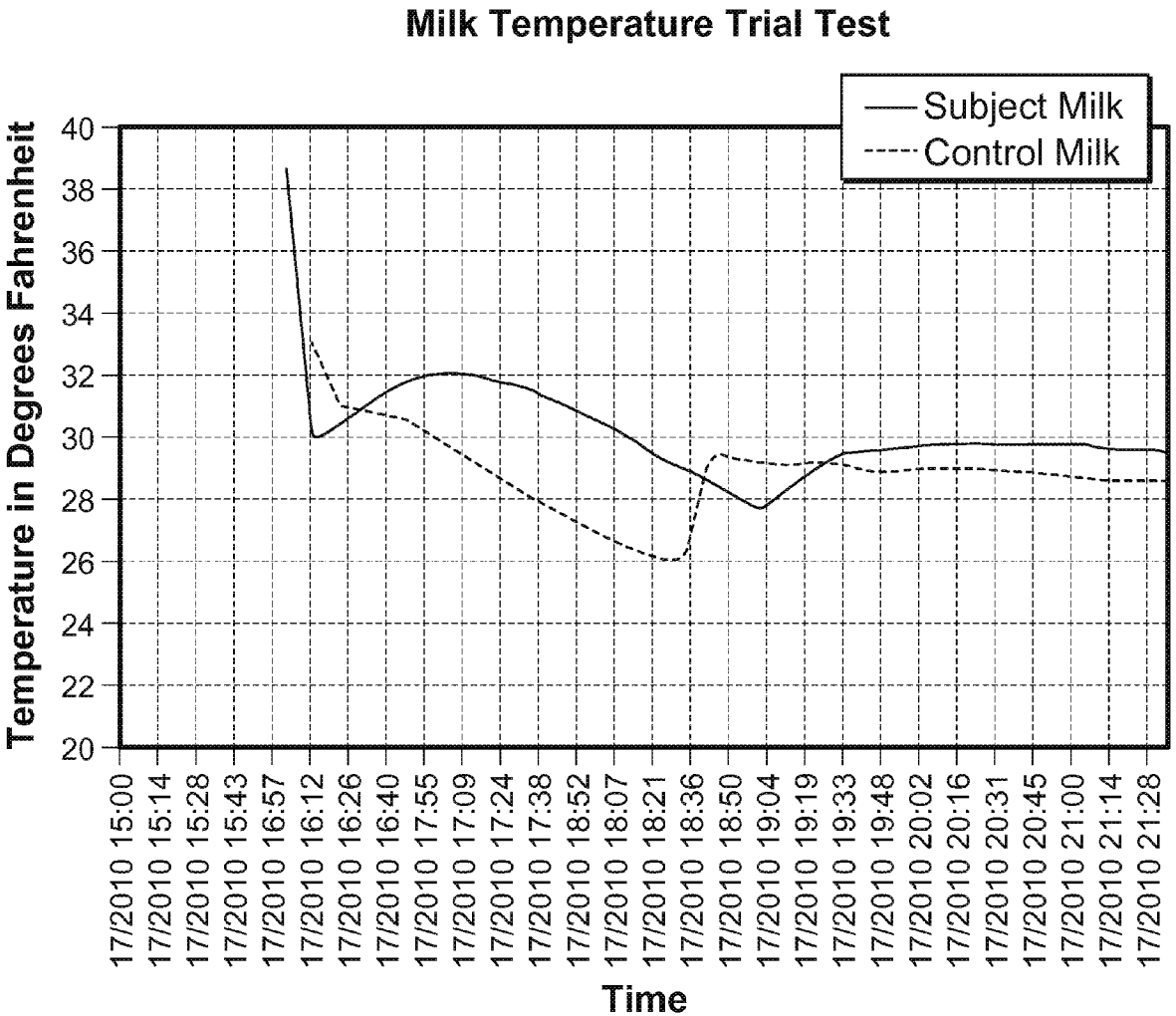
FIG. 3 illustrates the results of yet another experiment in which a heating element was placed into a base compartment of a multicompartment cooler with the outside temperature being cold in accordance with an aspect of the disclosure.

FIG. 3 shows the results of yet another experiment in which a heating element (e.g., a chemical heating pad, etc.) was placed into a base compartment 101*a* of a multicompartment cooler with the outside temperature being cold in accordance with an aspect of the disclosure. FIG. 3 shows that, by placing a heating element into the base compartment 101*a* of a multicompartment cooler, the length of time before the contents of the intermediate compartment 103*a* of the cooler (in this case, milk) freezes may be increased. As shown in the graph of FIG. 3, at time 16:12, the experiment was started for the case where a heating element was placed into base compartment 101*a* ("subject milk") and the case where no heating element was placed into a standard one-compartment cooler ("control milk"). The point at which the "subject milk" line and the "control milk" line dramatically change slope (18:36 for the "control milk" line and 19:04 for the "subject milk" line) is the point at which the milk container breaks due to the milk freezing. Thus, FIG. 3 clearly shows that by adding a heating element to a multicompartment cooler with the vents 117*a* open, the length of time before the contents (e.g., milk containers) of the cooler break (i.e., freeze) may be prolonged. Moreover, because the compartmentalized cooler started out colder at 16:12, had the compartmentalized cooler started at the same temperature as the control, the compartmentalized cooler would likely have gone longer before the milk container in the compartmentalized cooler broke.

Figure 4:
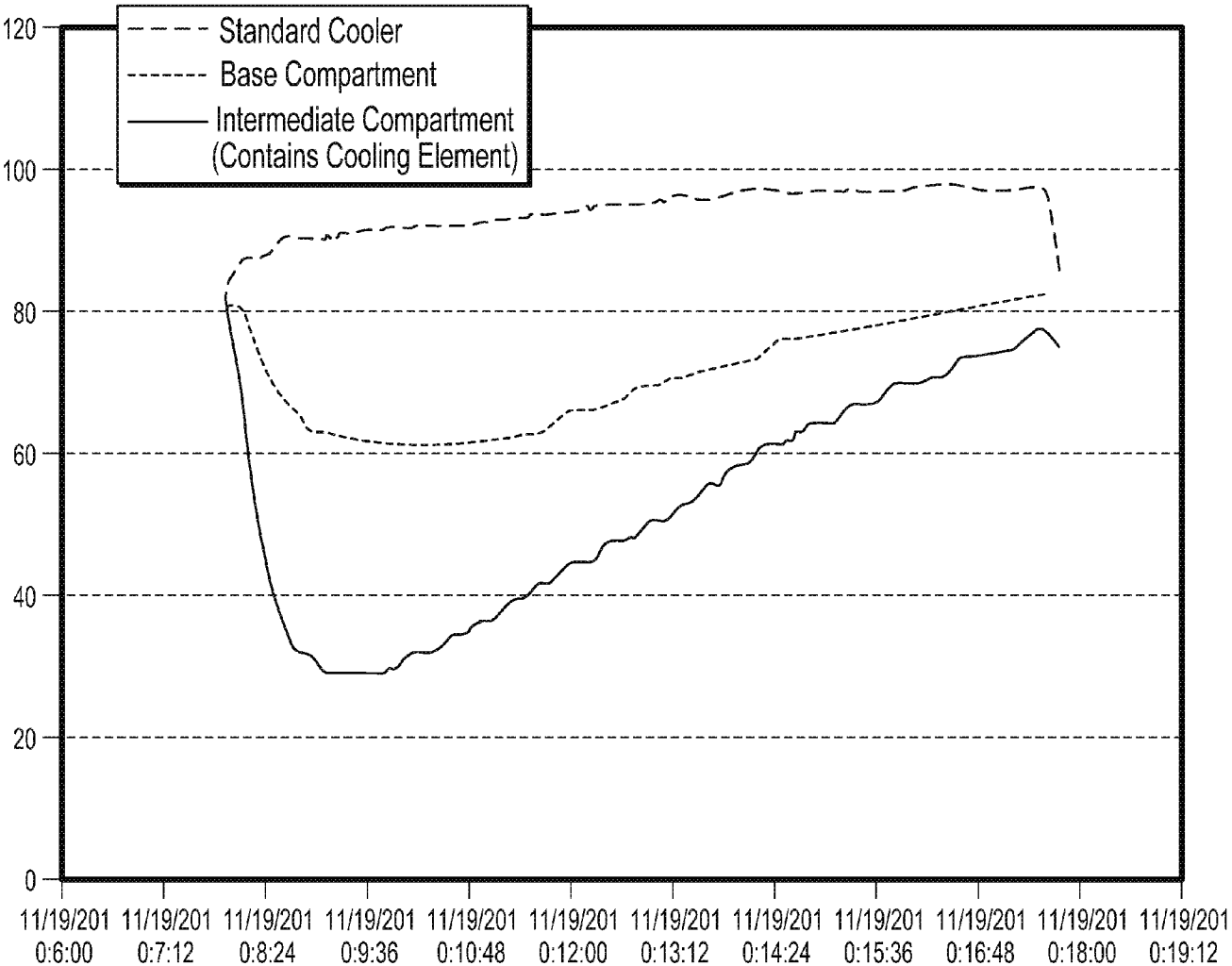
FIG. 4 illustrates the results of another experiment in which the vents between an intermediate compartment and a base compartment were closed when the intermediate compartment includes a cooling element and the base compartment is empty in accordance with an aspect of the disclosure.

Finally, FIG. 4 illustrates the results of another experiment in which the vents 117*a* between an intermediate compartment 103*a* and a base compartment 101*a* were closed when the intermediate compartment 103*a* includes a cooling element (e.g., dry ice) and the base compartment 101*a* is empty (the temperature outside the cooler is warm), in accordance with an aspect of the disclosure. In the graph of FIG. 4, the "standard cooler" line represents the temperature over time within a cooler without any cooling element placed inside the cooler. Moreover, the "base compartment" line represents the temperature over time within the base compartment 101*a* of a multicompartment cooler with a cooling element placed in the intermediate compartment 103*a* and the vents 117*a* between the base compartment 101*a* and the intermediate compartment 103*a* fully closed. Finally, the "intermediate compartment (contains cooling element)" line represents the temperature over time within the intermediate compartment 101*a* of a multicompartment cooler with a cooling element placed in the intermediate compartment 103*a* and the vents 117*a* between the base compartment 101*a* and the intermediate compartment 103*a* fully closed. FIG. 4 shows that there is some "leakage" of cool air from the intermediate compartment 103*a* to the base compartment 101*a* even when the vents 117*a* are closed. However, even though there is leakage between the intermediate compartment 103*a* and the base compartment 101*a*, FIG. 4 also shows that a temperature differential is still maintained between the two compartments over time when the vents 117*a* are closed.

The importance of temperature control within the various compartments of multicompartment cooler system 100*a* is underscored by the fact that bacteria, etc. may grow in food/drink products that are at the wrong temperature (See M. H. Zwietering et al., "Modeling of Bacterial Growth with Shifts in Temperature," Applied and Environmental Microbiology, 1994, pp. 204-213 and D. A. Ratkowsky et al., "Relationship Between Temperature and Growth Rate of Bacterial Cultures," Journal of Bacteriology, 1982, pp. 1-5.)

As indicated by the experimental results discussed above, when adjustable vents 117*a* are closed, hot/cool air from temperature element 111*a* may be confined to base compartment 101*a*. In yet other embodiments, adjustable vents 117*a* may be partially opened and closed to allow for a desired amount of diffusion between the base compartment 101*a* and intermediate compartment 103*a*. Thus, vents 117*a* may allow the user of cooler 100*a* to precisely control the temperature/moisture differential between base compartment 101*a* and intermediate compartment 103*a*.

In addition, adjustable vents 117*a* may be opened and closed manually or automatically. If opened manually, a user may be required to turn a knob attached to the slideable panel of vents 117*a*. Alternatively, if opened automatically, the slideable panel of vents 117*a* may be powered by a circuit within cooler 100*a*.

Although only one intermediate compartment 103*a* is shown in FIG. 1*a*, cooler 100*a* may include any number of intermediate compartments 103*a*, stacked one on top of another. Multiple intermediate compartments 103*a* may be secured one on top of another by the same technique used to secure base compartment 101*a* with a single intermediate compartment 103*a*. Alternatively, different techniques may be used to secure each intermediate compartment 103*a* to the compartments above and below.

Cooler 100*a* may also include a lid 105*a* to close off the top. Lid 105*a* may include a ridge 119*a* to allow the lid to fit snugly into the intermediate compartment 103*a*. Lid 105*a* may also include a temperature element 121*a* to heat/cool the intermediate compartment 103*a*. In some embodiments, temperature element 121*a* may lie in a recess in lid 105*a*. In other embodiments, temperature element 121*a* may be affixed to a wall of intermediate compartment 103*a*.

FIG. 1*b* illustrates a multicompartment cooler 100*b* with an assembled base compartment 101*b* in accordance with at least one aspect of the disclosure. Assembled base compartment 101*b* includes subcompartments 103*b*, 105*b*, and 107*b*. Base compartment 101*b* has been assembled into subcompartments 103*b*, 105*b*, and 107*b* by using removable compartment dividers, such as the one shown separating subcompartment 103*b* and 105*b*. It should be noted that while base compartment 101*b* is shown with only three subcompartments, any number of subcompartments may be included in base compartment 101*b* by using a different number of compartment dividers. Also, FIG. 1*b* illustrates how beverage containers 109*b* may be placed in subcompartment 103*b* of base compartment 101*b*. Although FIG. 1*b* shows only the base compartment 101*b* with subcompartments, similar approaches for creating subcompartments may be used for other compartments that are a part of cooler 100*b*.

Figure 5:
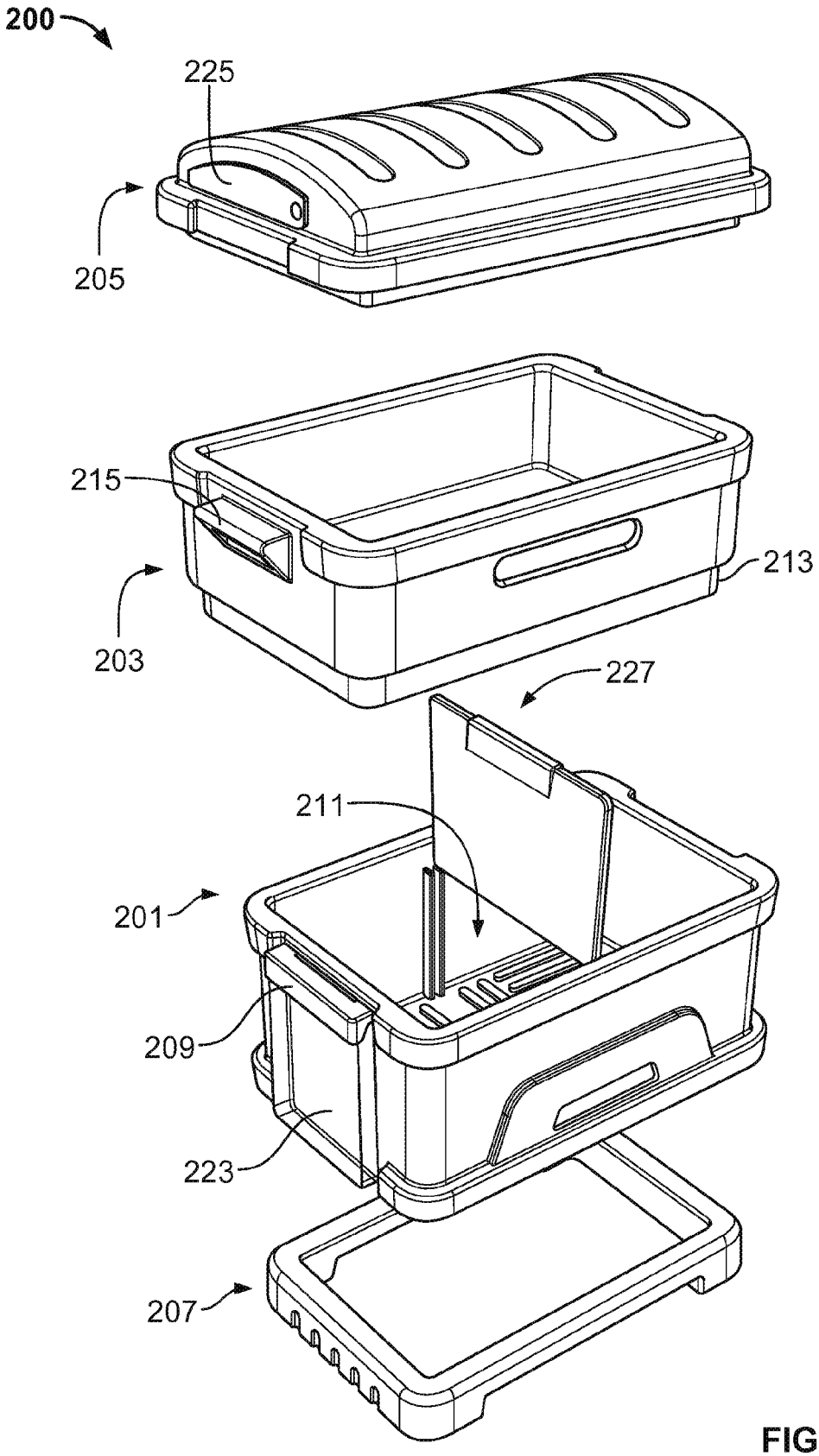
FIG. 5 illustrates a portable cooler with enhanced features, such as an automatic delivery flag and a transparent brochure receptor, in accordance with an aspect of the disclosure.

FIG. 5 illustrates a portable cooler with enhanced features, such as an automatic delivery flag and a transparent brochure receptor in accordance with at least one aspect of the disclosure. The portable cooler 200 shown in FIG. 2 may include a base 207, a base compartment 201, an intermediate compartment 203, and a lid 205. The base 207 may be used to lift the cooler such that the base compartment 201 is not in contact with the floor. This scheme may ensure that the base compartment 201 is not scratched, stained, or otherwise damaged by direct contact with the floor. More importantly, base 207 may ensure that the contents of base compartment 201 are protected in the event that chemicals, spills, and/or unwanted moisture on the floor are able to damage the base compartment 201 enough to harm the contents, if the base compartment 201 were in direct contact with the surface on which cooler 200 rests. In addition, base 207 may help to maintain a desired internal temperature of cooler 200 by insulating the base compartment 201 from thermal diffusion against the floor.

Base compartment 201 may fit snugly into a recess in base 207 or base 207 may fit snugly into a recess in base compartment 201. As before, base compartment 201 may include a handle 209, ribs 211, and/or a removable compartment divider 227. In addition, base compartment 201 may include a transparent brochure receptor 223. Brochure receptor 223 may be used to house documents related to the contents of cooler 200 and/or about an entity making the delivery. For instance, if a beverage company is delivering alcoholic beverages in cooler 200, the company may include details about different types of alcohol packed, contact information for the company, and/or other relevant information. Although these features are shown only for base compartment 201, they may be included in any of the intermediate compartments 203 that are a part of cooler 200.

Other features of cooler 200 shown in FIG. 2 include handle 215 and recess 213 for intermediate compartment 203. Recess 213 may aid in mating compartment 203 with base compartment 201.

Figure 6A:
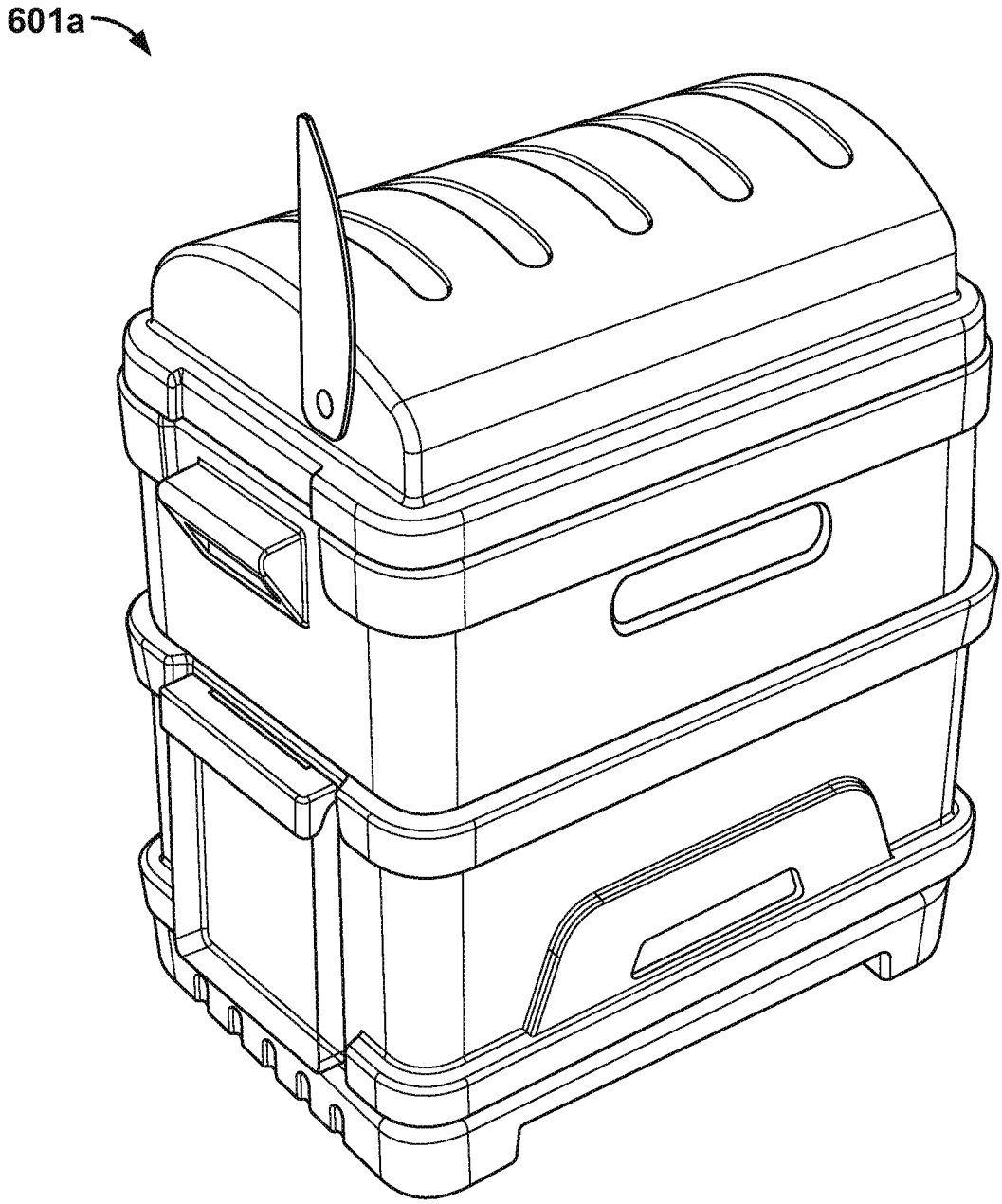
FIG. 6*a* illustrates a portable cooler with a delivery flag in the upright position in accordance with an aspect of the disclosure.
Figure 6B:
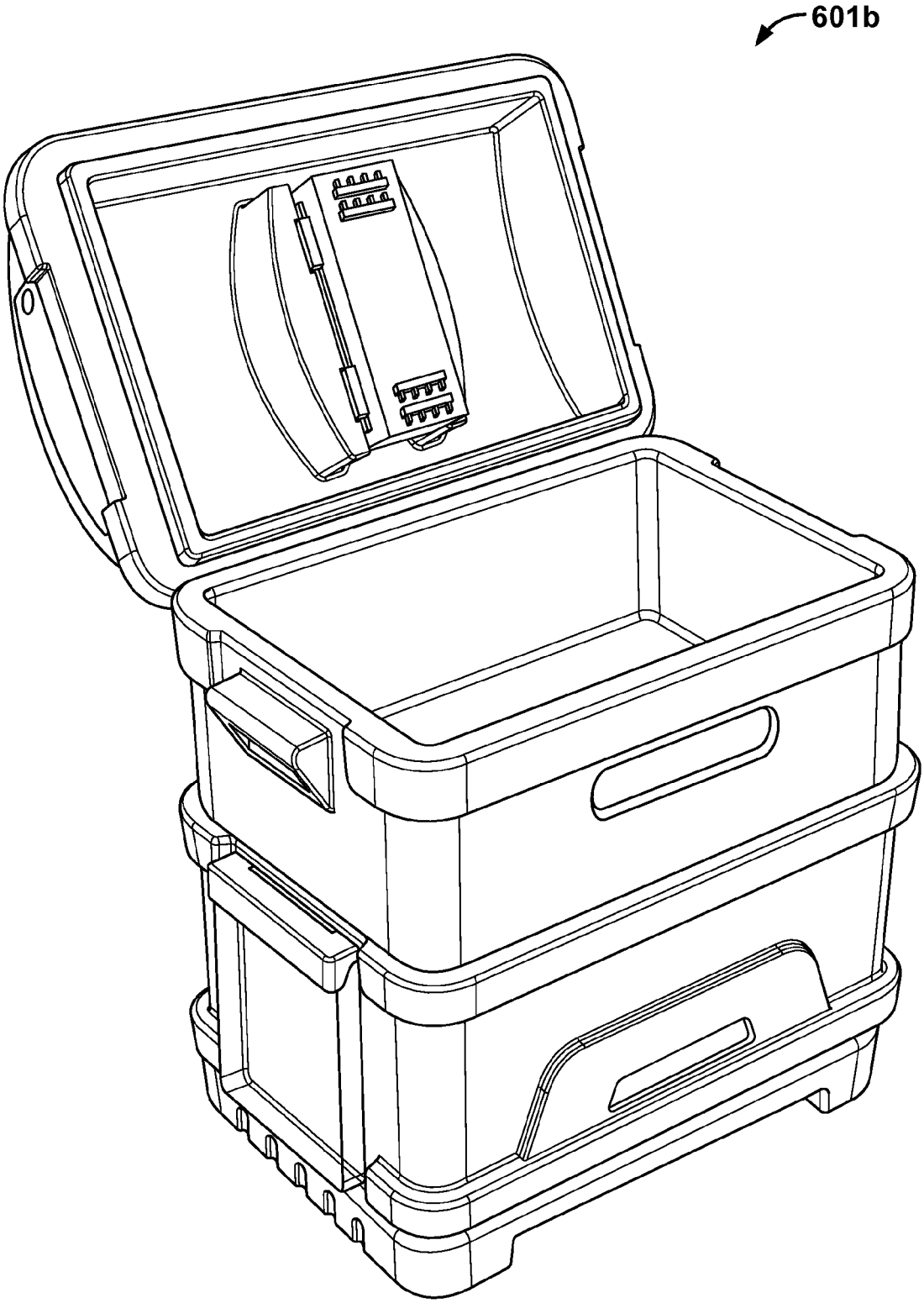
FIG. 6*b* illustrates a portable cooler with a delivery flag in the resting position in accordance with an aspect of the disclosure.

In addition, lid 205 may include a delivery flag 225 that may automatically flip down once the lid 225 is opened. The delivery flag may initially be flipped up when the cooler is delivered to its intended destination. FIG. 6*a* shows a portable cooler 601*a* with a lid closed and a delivery flag in the upright position in accordance with an aspect of the disclosure. For example, if milk cartons are delivered in cooler 200 of FIG. 5, the delivery agency may place the cooler 200 outside a customer's home. When the customer discovers that the delivery has been made and opens lid 205 to unpack cooler 200, a hinge that opens lid 205 may simultaneously move delivery flag 225 down to its resting position. FIG. 6*b* shows a portable cooler 601*b* with a lid open and a delivery flag in the resting position in accordance with an aspect of the disclosure.

In addition, cooler 200 of FIG. 5 may be modular such that any of the compartments, dividers, brochure receptors, handles, and/or lids may be interchangeable from one location to another. For instance, a lid for a cooler with a base compartment secured to an intermediate compartment topped off with the lid may be used to close another cooler with just a single compartment. In other words, the parts used to assemble cooler 200 may be used to assemble coolers of various sizes and complexities. As another example, by adding and removing compartment dividers to/from the compartments of cooler 200, coolers may be custom designed to fit the needs of a user for a particular application.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A cooler comprising:

a base compartment;

a base component affixed to the base compartment for raising the cooler from ground, wherein the base component is fitted to the base compartment by using a first recess along a first periphery of the base compartment, wherein the first recess fits snugly into a first ridge along a second periphery of the base component;

a first intermediate compartment fitted to the base compartment, wherein the base compartment is fitted to the first intermediate compartment by using a second recess along a third periphery of the first intermediate compartment, wherein the second recess fits snugly into a second ridge along a fourth periphery of the base compartment;

a temperature-effecting element in the base compartment and the first intermediate compartment, wherein the temperature-effecting element comprises one of a container comprising dry ice and a chemical pad;

a second intermediate compartment fitted to the first intermediate compartment;

a third intermediate compartment fitted to the second intermediate compartment;

ribs attached to inside walls of the base compartment, the first intermediate compartment, the second intermediate compartment, and the third intermediate compartment, wherein the ribs are configured to prevent contents of the base compartment, the first intermediate compartment, the second intermediate compartment, and the third intermediate compartment from touching the inside walls;

handles attached to an outer surface of one of the base compartment, the first intermediate compartment, the second intermediate compartment, and the third intermediate compartment;

a lid securely attached to a top of the cooler;

a transparent brochure receptor attached to at least one of the base compartment, the first intermediate compartment, the second intermediate compartment, and the third intermediate compartment; and a branding area on an outside wall of the cooler for including a brand associated with the cooler, wherein a common surface of the base compartment and the first intermediate compartment includes a plurality of adjustable vents with rotatable panels for controlling temperatures within each of the base compartment and the first intermediate compartment.

2. The cooler of claim 1, further comprising: a delivery flag attached to the lid.

3. The cooler of claim 2, wherein the delivery flag automatically flips down once the lid is opened.

4. A cooler comprising:

a base compartment;

a first intermediate compartment;

a lid securely attached to a top of the cooler; and a delivery flag attached to the lid, wherein the delivery flag automatically flips down once the lid is opened, wherein at least one surface of the base compartment and the first intermediate compartment includes a plurality of adjustable vents with rotatable panels for maintaining temperatures for the base compartment and the first intermediate compartment.

5. The cooler of claim 4, further comprising: a base component affixed to the base compartment for raising the cooler from ground.

6. The cooler of claim 5, wherein the base component is fitted to the base compartment by using a recess along a first periphery of the base compartment, wherein the recess fits snugly into a ridge along a second periphery of the base component.

7. The cooler of claim 4, further comprising: a second intermediate compartment fitted to the first intermediate compartment.

8. The cooler of claim 7, further comprising: a third intermediate compartment fitted to the second intermediate compartment.

9. The cooler of claim 4, further comprising: a temperature-effecting element in the base compartment and the first intermediate compartment.

10. The cooler of claim 9, wherein the temperature-effecting element comprises a container comprising dry ice.

11. The cooler of claim 9, wherein the temperature-effecting element comprises a chemical pad.

12. The cooler of claim 4, further comprising: ribs attached to walls of the base compartment, wherein the ribs are configured to prevent contents of the base compartment from touching the walls.

13. The cooler of claim 4, further comprising: handles attached to an outer surface of the base compartment.

14. The cooler of claim 4, wherein the base compartment is fitted to the first intermediate compartment by using a recess along a first periphery of the first intermediate compartment, wherein the recess fits snugly into a ridge along a second periphery of the base compartment.

15. The cooler of claim 4, further comprising: a transparent brochure receptor attached to the base compartment.

16. The cooler of claim 4, further comprising: a branding area on an outside wall of the cooler for including a brand associated with the cooler.

* * * * *